US005642833A

United States Patent [19]

Ring

[11] Patent Number: 5,642,833

[45] Date of Patent: Jul. 1, 1997

[54] COMPOSITE PACKAGE FOR SCOOPABLE PRODUCTS

[75] Inventor: Carl D. Ring, Oakland, Tenn.

[73] Assignee: Ring Can Corporation, Oakland, Tenn.

[21] Appl. No.: 664,793

[22] Filed: Jun. 17, 1996

Related U.S. Application Data

[63] Continuation of Ser. No. 413,112, Mar. 29, 1995, abandoned.

[51] Int. Cl.[6] ..... B65D 90/04

[52] U.S. Cl. ..... 220/441; 229/117.16; 229/235

[58] Field of Search ..... 229/89, 90, 239, 229/240, 241, 235, 117.16; 215/395, 396; 206/217, 595; 220/408, 410, 415, 441

[56] References Cited

U.S. PATENT DOCUMENTS

| | | | |
|---|---|---|---|
| 2,046,562 | 7/1936 | Kane et al. | 229/89 |
| 2,352,503 | 6/1944 | Walton . | |
| 2,788,933 | 4/1957 | Kessler | 229/198.1 X |
| 2,808,190 | 10/1957 | Buhrmaster et al. . | |
| 2,865,552 | 12/1958 | Sider et al. . | |
| 3,070,275 | 12/1962 | Bostrom . | |
| 3,160,326 | 12/1964 | Sturdevant et al. | 220/410 X |
| 3,246,825 | 4/1966 | Zastrow | 220/408 |
| 3,445,050 | 5/1969 | Peters et al. . | |
| 3,464,619 | 9/1969 | Nordstrom | 229/117.16 X |
| 3,722,754 | 3/1973 | Struble . | |
| 3,871,568 | 3/1975 | Bahler | 220/410 X |
| 4,169,539 | 10/1979 | Price . | |
| 4,696,840 | 9/1987 | McCullough et al. . | |
| 4,782,945 | 11/1988 | Geiler et al. | 220/410 X |
| 4,834,255 | 5/1989 | Boots . | |
| 4,927,042 | 5/1990 | Ring | 220/410 X |
| 4,982,867 | 1/1991 | Dubois et al. | 220/408 X |
| 5,071,025 | 12/1991 | Boots . | |
| 5,236,128 | 8/1993 | Stone et al. . | |
| 5,299,700 | 4/1994 | Beniacar | 220/410 X |

FOREIGN PATENT DOCUMENTS

| | | | |
|---|---|---|---|
| 2106398 | 2/1971 | Germany | 229/235 |
| 1364053 | 8/1974 | United Kingdom . | |
| 9303966 | 3/1993 | WIPO . | |

*Primary Examiner*—Allan N. Shoap
*Assistant Examiner*—Christopher J. McDonald
*Attorney, Agent, or Firm*—Nies, Kurz, Bergert & Tamburro

[57] ABSTRACT

A composite package for scoopable products comprising an outer rectangular paperboard box having vertical front, rear, and side walls and an upper foldable flap assembly connected to said vertical walls. An inner thin-walled plastic jar has a lower generally rectangular portion fitting within said box and an upper portion of slightly reduced cross-sectional size provided with a large open mouth. The lid is removably connected over said mouth and is normally covered by the flap assembly. The upper portion has wall sections spaced inwardly from opposed walls of the box to provide finger receiving spaces therebetween, and the opposed walls have finger receiving openings adjacent said spaces to facilitate handling of said box.

7 Claims, 2 Drawing Sheets

COMPOSITE PACKAGE FOR SCOOPABLE PRODUCTS

This application is a continuation of application No. 08/413,112, filed Mar. 29, 1995, now abandoned.

BACKGROUND OF THE INVENTION

This invention relates generally to containers for scoopable products and more particularly, to a novel composite package consisting of an outer paperboard box and an inner, thin-walled, plastic jar supported within the box and especially designed for holding scoopable products such as margarine, shortening, pickles and potato salad, bird seed, pet food, cat litter, pool chemicals, and the like.

Scoopable products such as margarine and shortening are most commonly supplied to the commercial food industry, in large rigid plastic pails or buckets of about two to six gallons in size. The pails are usually circular in cross section, slightly tapered inwardly from top to bottom to accommodate the injection molding process by which they are normally produced. The pails usually have a large open top sealed by a removable lid.

Although these type pails have found wide use in commercial and industrial applications, they do suffer from a number of disadvantages. Because of the substantial wall thickness of the plastic material, the price of the pails is very high. Also adding to the overall cost of using those type pails is the inefficient space utilization of the pails during shipping, handling, and storage because of their round and tapered shape. Further, the lids placed on the open top of the pails are often difficult to apply and remove, sometimes requiring a rubber mallet to beat the top on, and a pry bar of some type to remove the top. Additionally, the pails are difficult to dispose of and have been known to present a drowning hazard to small children should they become filled with water.

Another type of container which has been suggested for use with scoopable products is a "bag-in-box" which includes an outer paperboard box lined with an inner, flexible, plastic bag. This type of container also suffers several disadvantages. For example, the bag and the box are normally shipped to a customer as separate components and they must be assembled together by the customer before the package is filled. Further, the bag itself or the bag in the box has no convenient resealing system, which creates problems once the bag is opened. Also, the products in the container, for example, margarine or shortening, can be trapped in the folds or wrinkles of the bag and scraping the sides of the bag to try to scoop out all of the product can cause the bag to shift, collapse, or rupture, none of which is desirable.

Thus, a need exists for a lower-cost, space-saving, easier-handling package for holding scoopable products. Applicant and the assignee of this application are familiar with prior art composite packages consisting of a thin-walled plastic bottle in an outer paperboard box for holding pourable liquid products, with the top of the bottle provided with a small spout through which the liquid may be poured from the bottle and an integrally molded handle for holding the package during the pouring operation. However, prior to this invention, those types of composite packages have not been known for use with scoopable products.

SUMMARY OF THE INVENTION

Accordingly, the primary object of this invention is to provide a novel, composite package comprising a large mouth, thin-walled, lightweight, blown plastic jar in an outer paperboard box suitable for holding scoopable products such as margarine, shortening, or the like.

Another object of the invention is to provide the above-described novel composite package wherein the plastic jar acts as a smooth, self-supporting, inner liner with a large top opening for holding the scoopable products and the outer paperboard box acts as a strong outer shell for shipping, stacking, and handling purposes. After filling, the large open mouth of the jar is sealed with a snap-on or thread-on plastic lid and the paperboard box has an upper flap assembly which is closed and sealed to protect the inner jar during shipping and storage. A tear strip extending around the box just below the upper flap assembly enables the end user to quickly remove the flap assembly and gain access to the lid on the jar.

Still another object of the invention is to provide the above, novel, composite package in which the plastic jar is substantially square and fits closely within a substantially square paperboard box to not only maximize the storage capacity of the package, but also to utilize most efficiently the shipping and stacking space on a standard 40"×48" grocery pallet.

A further object of the invention is to provide the above novel composite package in which the thin walled plastic jar is easily crushed to facilitate its disposal and avoid any safety hazards. Similarly, the outer paperboard box can be quickly flattened and recycled in existing municipal recycling systems.

Other objects and advantages of the invention will become apparent from reading the detailed description of the invention in which reference is made to the accompanying drawings where like numerals indicate like elements.

DETAILED DESCRIPTION OF THE INVENTION

Figure 2:
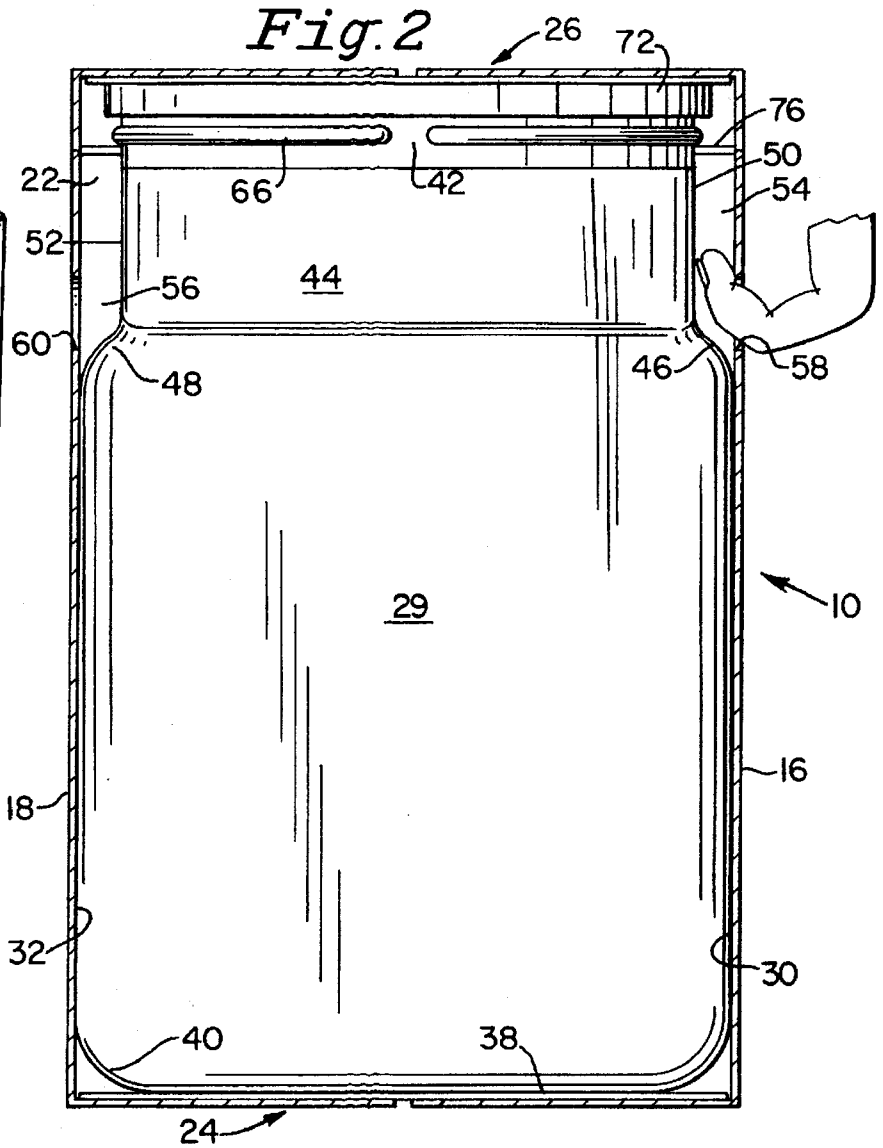
FIG. 2 is a fragmented sectional view taken generally along the line 2—2 of FIG. 1.
Figure 1:
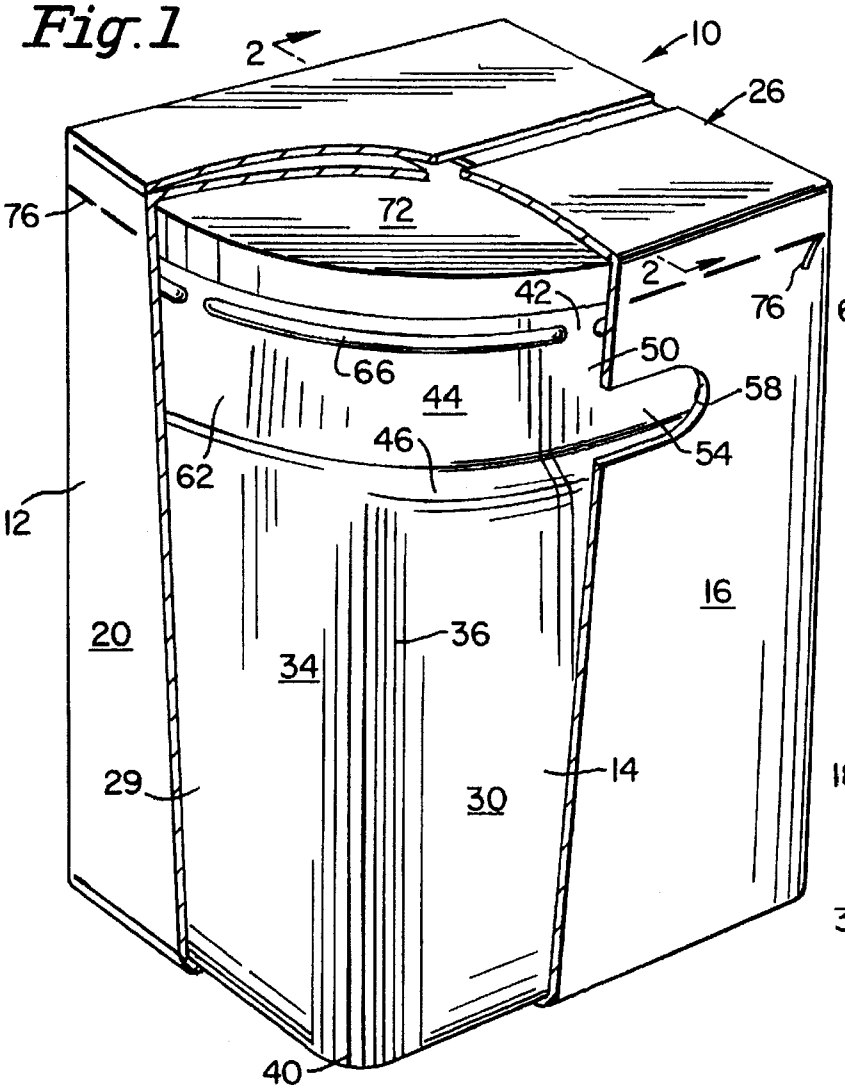
FIG. 1 is a fragmented generally perspective view of the novel composite package of the invention.
Figure 3:
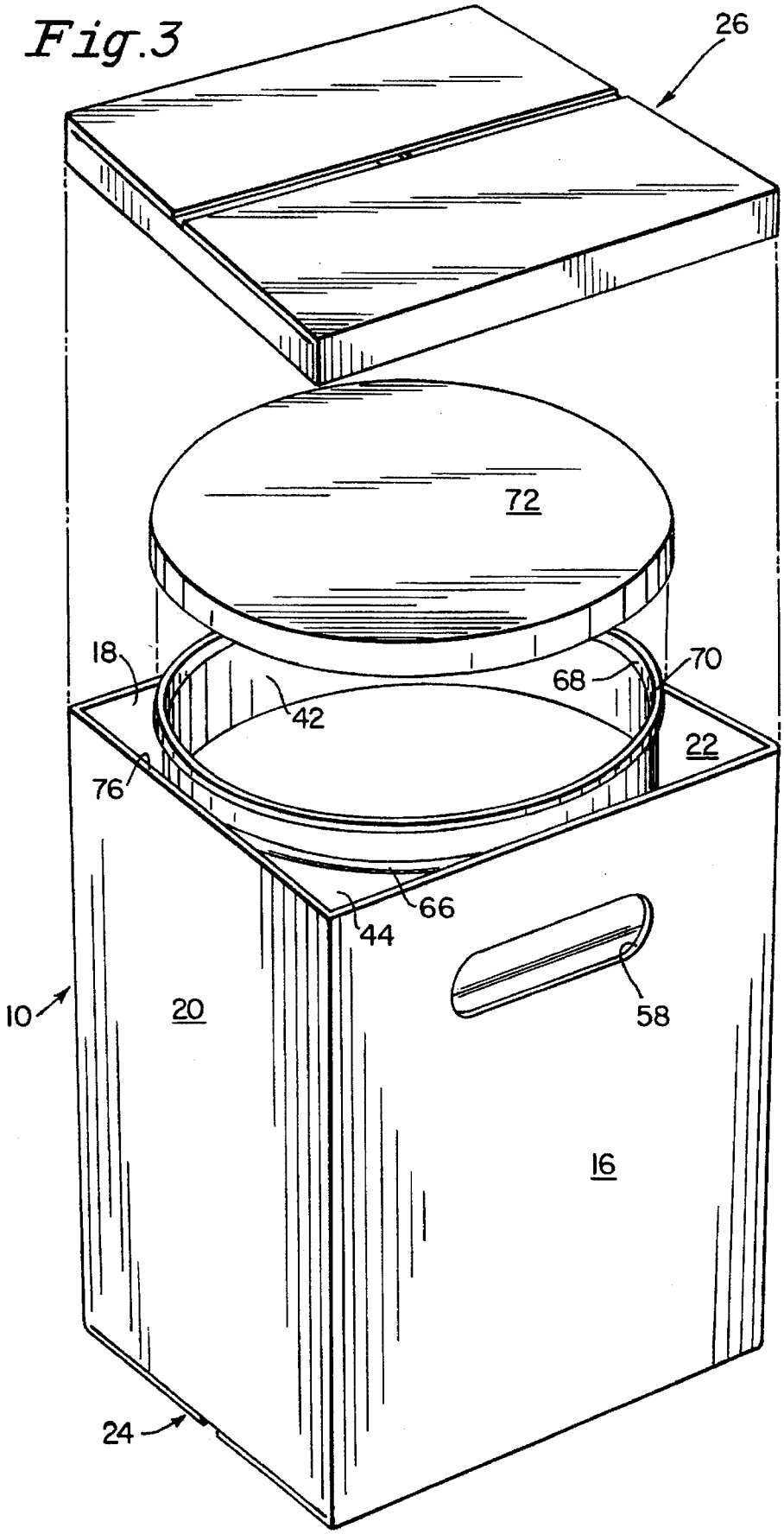
FIG. 3 is a generally exploded perspective view of the composite package of the invention illustrating the lid of the jar and the top flap assembly of the paperboard box in their removed positions.

Referring now to the drawings, the composite package 10 of the invention includes a substantially square outer corrugated paperboard box 12 and a substantially square inner large mouth lightweight thin-walled but self-supporting plastic jar 14 fitting closely within paperboard box 12.

Box 12 includes vertical front and rear walls 16 and 18, respectively, side walls 20 and 22, a bottom flap assembly 24, and a top flap assembly 26.

The thin-walled plastic jar 14 is manufactured by a blow-molded process and includes a substantially square lower portion 29 having opposed front and rear walls 30 and 32, opposed side walls 34 joined with walls 30 and 32 at large radiused corners 36, and a bottom wall 38 joining the vertical walls at a large radiused corner 40. The wall thickness of the jar is about 0.025 inches.

As seen in the drawings, the upper end 42 of bottle 14 is circular in cross-section, and the change from the square cross-section of lower portion 29 is accomplished by the contoured transitional area 44 extending between square portion 29 and circular section 42. Transition area 44 includes inwardly radiused sections 46 and 48 which join curved vertical wall sections 50 and 52 that are spaced inwardly from box walls 16 and 18 to provide ample finger receiving clearance spaces 54 and 56 between sections 50 and 52 and walls 16 and 18. Walls 16 and 18 are provided with finger receiving die-cut slots 58 and 60 by which the composite package may be gripped for moving and handling purposes.

Sections 62 of transitional area 44 which extend between side walls 34 and circular section 42 generally taper upwardly inwardly and blend smoothly with sections 50 and 52.

Section 42 is provided with a plurality of interrupted circular reinforcing ribs 66 spaced beneath its large circular open mouth 68 defined by a continuous circular flange 70, over which a snap-on lid 72 may be quickly placed or removed to seal or provide access to the contents of jar 14. The size of section 42 and mouth 68 are made as large as possible with respect to the top opening of box 12 so that the end user can quickly and easily scoop virtually all of the contents out of jar 14. The upper end of jar 14 is slightly reduced in size only a sufficient amount to provide finger clearance spaces 54 and 56 and to provide sufficient clearance for application and removal of the snap-on lid 72.

In assembling the composite package, box 12 is set up from a flat, paperboard blank and the bottom flap assembly 24 is glued together. A plastic jar 14 is then inserted into box 12 with the lid 72 removed. The jar is then filled with margarine or the like, and the lid 72 is snapped in place. The upper foldable flap assembly 26 is then glued down and the filled package 10 is shipped to an end user. To facilitate use by the end user, box 12 is provided with a tear strip 76 extending around the periphery of its side walls at a point below lid 72 to provide for complete removal of upper flap assembly 26 and afford ready and convenient access to lid 72.

For sizes up to five gallons, the composite package 10 is of substantially square dimensions, for example, 9.7"×9.4" footprint, which adapts conveniently to a conventional 40"×48" pallet and pallet utilization has been found to be approximately 95% efficient. For sizes five gallons and larger, the footprint may be 9.7"×11.7" to make the pallet more stable while still efficiently utilizing pallet space. The size of the package 10 can be readily varied because the inner jar is manufactured by a blow molding process, and for each footprint, a single inexpensive mold can produce all of the required sizes or anything in between by simply adding or removing height segments from a central section of the mold.

While the lid 72 has been described as a circular snap-on type, it may be designed as a square snap-on type, or as a circular screw-on lid. Similarly, for some applications, box 12 may be provided with a carrying handle or strap instead of die cut openings 58 and 60.

Numerous advantages of the composite package 10 of the invention are readily apparent from the description above. The mouth 68 is very large, and the interior surfaces of jar 14 are very smooth to enable an end user to easily scoop virtually all of the contents out of the jar. The large radiuses 36 and 40 and the smooth contoured transition section 44 make for easy filling, scooping, and scraping of the contents from the jar. In addition, the package 10 can be offered in a variety of sizes and with a variety of lid types to suit a particular application. The package 10 is very light, and less expensive than the conventional heavy-walled pails. After use, the outer box 12 can be easily flattened and recycled and the inner thin-walled plastic jar 14 is easily crushed and disposed of. Furthermore, after the jar 14 is filled and sealed with lid 72 and the flap assembly 26 is glued down in place, the closed flap assembly keeps dust, dirt, rodents, etc. away from jar 14 during shipping and storage of package 10. Hence, when flap assembly 26 is removed by pulling on tear strip 76, the lid 72 and jar 14 are clean and ready for use.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A composite package comprising an outer rectangular paperboard box having vertical front, rear, and side walls and an upper foldable flap assembly connected to said vertical walls, an inner thin-walled plastic jar having a lower generally rectangular portion fitting within said box and an upper portion of slightly reduced cross-sectional size provided with a large open mouth, a lid removably connected over said mouth, said lid being separate from but normally covered by said flap assembly, said upper portion having wall sections spaced inwardly from opposed walls of said box to provide finger receiving spaces therebetween, said opposed walls having finger receiving openings adjacent said spaces to facilitate handling of said box, means permitting complete removal of said upper flap assembly from said walls to provide access to said lid, said removal means being located between said upper flap assembly and said finger receiving openings.

2. The composite package of claim 1, said removal means comprising a tear strip extending around said box walls at a location below said lid.

3. The composite package of claim 1, wherein said mouth is circular.

4. The composite package of claim 1, wherein said mouth is circular and said jar includes a smooth contoured transitional section extending between said lower and upper portions.

5. A composite package for use with scoopable products comprising an outer rectangular paperboard box having vertical front, rear, and side walls and an upper foldable flap assembly connected to said vertical walls, an inner thin-walled plastic jar having a lower generally rectangular portion fitting within said box, an upper portion of slightly reduced cross-sectional size provided with a large circular open mouth substantially concentric with said lower rectangular portion through which a scoop may pass to remove product from within said jar, and a smooth contoured transitional section extending between said lower rectangular portion and said upper portion, a lid removably connected over said mouth, said lid being separate from but normally covered by said flap assembly, said transitional section having wall sections spaced inwardly from opposed walls of said box to provide finger receiving spaces therebetween, said opposed walls having finger receiving openings adjacent said spaces to facilitate handling of said box.

6. The composite package of claim 5, comprising means permitting complete removal of said upper flap assembly from said walls to provide access to said lid, said removal means being located between said upper flap assembly and said finger receiving openings.

7. The composite package of claim 6, said removal means comprising a tear strip extending around said box walls at a location below said lid.

* * * * *